United States Patent [19]

Terauchi

[11] Patent Number: 4,626,179

[45] Date of Patent: Dec. 2, 1986

[54] AXIAL THRUST LOAD MECHANISM FOR A SCROLL TYPE FLUID DISPLACEMENT APPARATUS

[75] Inventor: Kiyoshi Terauchi, Isesaki, Japan

[73] Assignee: Sanden Corporation, Iseaki, Japan

[21] Appl. No.: 671,306

[22] Filed: Nov. 14, 1984

[30] Foreign Application Priority Data

Nov. 14, 1983 [JP] Japan ..... 58-212526

[51] Int. Cl.[4] ..... F01C 1/04

[52] U.S. Cl. ..... 418/55

[58] Field of Search ..... 418/55, 57, 59

[56] References Cited

U.S. PATENT DOCUMENTS 3,994,633 11/1976 Shaffer ..... 418/55

4,259,043 3/1981 Hidden et al. ..... 418/55

FOREIGN PATENT DOCUMENTS 49881 4/1982 European Pat. Off. ..... 418/55

55-51982 4/1980 Japan ..... 418/55

*Primary Examiner*—John J. Vrablik

*Attorney, Agent, or Firm*—Banner, Birch, McKie & Beckett

[57] ABSTRACT

A scroll type fluid displacement apparatus includes a pair of scrolls each having a circular end plate from which a spiral element extends. Both spiral elements interfit at an angular and radial offset to make a plurality of line contacts to define at least one pair of sealed off fluid pockets. One scroll, the orbiting scroll, is operatively connected to a driving mechanism and a rotation preventing mechanism, such as a ball coupling device, to effect orbital motion thereof. As the orbiting scroll orbits, the sealed off fluid pockets move along the shifting line contacts of the spiral elements to change the volume of the fluid pockets. According to the present invention, the number of turns of the orbiting and fixed spiral elements are different so that these spiral elements are of different length. As a result, the gas pressure distribution within the fluid pockets is asymmetrical which results in a larger moment of rotation for the orbiting scroll. This larger moment of rotation acts on the balls of the ball coupling device to prevent vibration and reduce noise.

4 Claims, 6 Drawing Figures

AXIAL THRUST LOAD MECHANISM FOR A SCROLL TYPE FLUID DISPLACEMENT APPARATUS

BACKGROUND OF THE INVENTION

This invention relates to a scroll type fluid displacement apparatus, and more particularly, to an axial thrust load supporting mechanism for an orbiting scroll of a scroll type fluid displacement apparatus.

Scroll type fluid displacement apparatus are well known in the prior art. For example, U.S. Pat. No. 801,182 issued to Creux discloses such apparatus which includes two scrolls each having a circular end plate and a spiroidal or spiral involute element. The scrolls are maintained angularly and radially offset so that both spiral elements interfit to form a plurality of line contacts between their spiral curved surfaces to thereby seal off and define at least one pair of fluid pockets. The relative orbital motion of the scrolls shifts the line contacts along the spiral curved surfaces and, as a result, the volume of the fluid pockets increases or decreases dependent on the direction of the orbital motion. Thus, scroll type fluid displacement apparatus may be used to compress, expand or pump fluids.

Generally, in conventional scroll type fluid displacement apparatus, one scroll is fixed to a housing and the other scroll is an orbiting scroll. The orbiting scroll normally is eccentrically supported on a drive or crank pin of a drive shaft, which causes orbital motion of the orbiting scroll upon rotation of the drive shaft. Also, a conventional scroll type fluid displacement apparatus includes a rotation preventing mechanism which prevents rotation of the orbiting scroll to thereby maintain the fixed and orbiting scrolls in a predetermined angular relationship during operation of the apparatus.

Because the orbiting scroll in conventional scroll type fluid displacement apparatus normally is supported on the crank pin in a cantilever manner, an axial slant of this orbiting scroll naturally occurs. Axial slant also occurs because the movement of the orbiting scroll is not rotary motion around the center of the orbiting scroll, but is orbiting motion caused by the eccentric movement of the crank pin as this crank pin is driven by the rotation of the drive shaft. Several problems result from the occurrence of this axial slant including improper sealing of line contacts, vibration of the apparatus during operation and noise caused by physical striking of the spiral elements. One simple and direct solution to these problems is the use of a thrust bearing device for carrying the axial loads. Thus, a conventional scroll type flid displacement apparatus usually is provided with a thrust bearing device.

One recent attempt to improve the rotation preventing and thrust bearing devices in scroll type fluid displacement apparatus is described in U.S. Pat. No. 4,160,629 (Hidden et al.) and U.S. Pat. No. 4,259,043 (Hidden et al.) In the apparatus of these patents, the rotation preventing and thrust bearing functions are integral with one another. A rotation preventing/thrust bearing mechanism according to these patents includes one set of identations formed on the outer end surface of the circular end plate of the orbiting scroll and a second set of indentations formed on the end surface of a fixed plate attached to the housing of the apparatus. A plurality of balls or spheres are placed between the indentations formed on these surfaces to carry the axial load and prevent rotation of the orbiting scroll.

In the above described rotation preventing/thrust bearing device, the maximum orbital radius of this rotation preventing/thrust bearing device is defined by factors such as diameter of the balls, diameter of the indentations formed on each surface and the displacement of the balls in the indentations, whereas the orbital radius of the orbiting scroll is defined by the number of turns of the spiral element. Nevertheless, the orbital radius of both the rotation preventing/thrust bearing device and the orbiting scroll should be the same to effectively perform the function of rotation prevention. However, because of dimensional errors caused by the manufacture of parts and the assembly of the apparatus, the orbital radius of the rotation preventing/thrust bearing device must be made larger than the orbital radius of the orbiting scroll to maintain the seal of the fluid pockets. Unfortunately, this variance in the orbital radius due to manufacturing tolerances results in the disadvantage of too much play in the movement of the balls within the device.

Furthermore, the moment of rotation ($\rho$) of the orbiting scroll, which is in the same direction as the rotating drive shaft, is defined by the following formula:

$$\tau(\text{moment of rotation}) = Fg \times \frac{1}{2} r_o$$

wherein Fg is the resultant force of the gas pressure acting on the spiral element and $r_o$ is the distance between the center of the fixed scroll and the center of the orbiting scroll (hereinafter called the "crank radius"). Though this moment of rotation acts on the rotation preventing/thrust bearing device, occasionally the direction of the moment is offset from the rotating direction of the drive shaft due to changes in the gas pressure force. When this occurs in the above described rotation preventing/thrust bearing device, because of the play of the balls in this device, the direction of force acting on the balls changes which causes vibration.

Referring to FIGS. 1 and 2, the above phenomenon will be described. FIG. 1 is a diagrammatic sectional view illustrating the relationship of conventional fixed and orbiting scroll. FIG. 2 is a pressure distribution graph illustrating the pressure in sealed off pockets taken along line A—A in FIG. 1. In conventional scrolls, the number of turns of the spiral elements in both scrolls is the same, i.e., the fixed and orbiting scrolls are formed as mirror images. As a result, as shown in FIG. 2, the gas pressure distribution is symmetrical about the midpoint of crank radius $r_o$. Thus, the resultant force of gas pressure Fg acts on the midpoint of crank radius $r_o$ perpendicular to the direction of crank radius $r_o$. The force Fd, which is the same vector force as the resultant force Fg but in the opposite direction, acts on the center of the orbiting scroll to balance the resultant force Fg. Therefore, forces Fg and Fd create the moment of rotation or a rotating force defined by $Fg \times r_o/2$. This rotating force is dependent on changes in gas pressure so that, in the rotation preventing/thrust bearing device described above, play of the balls occurs within the rotation preventing/thrust bearing device resulting in undesirable vibration and noise.

SUMMARY OF THE INVENTION

It is a primary object of this invention to provide an improved scroll type fluid displacement apparatus in which unnecessary vibration and noise in the rotation preventing/thrust bearing device is prevented.

It is another object of this invention to provide a scroll type fluid displacement apparatus which is simple in construction and light in weight.

A scroll type fluid displacement apparatus includes a pair of scrolls, each of which comprises a circular end plate and a spiral wrap extending from or affixed on one end surface of the circular end plate. Both spiral wraps interfit at an angular and radial offset to form a plurality of line contacts to define at least one pair of sealed off fluid pockets. A driving mechanism is operatively connected to one of the scrolls to effect orbital motion. A ball coupling/thrust bearing device is connected to the orbiting scroll for preventing the rotation of the orbiting scroll during orbital motion to thereby change the volume of the fluid pockets. However, unlike conventional scroll type fluid displacement apparatus, the lengths of the spiral wraps of the scrolls are different in order to reduce vibration and noise in the ball coupling/thrust bearing device.

Further objects, features and other aspects of this invention will be understood from the following detailed description of the preferred embodiment of this invention referring to the annexed drawings.

DETAILED DESCRIPTION OF THE PREFERRED EMBODIMENT

Figure 3:
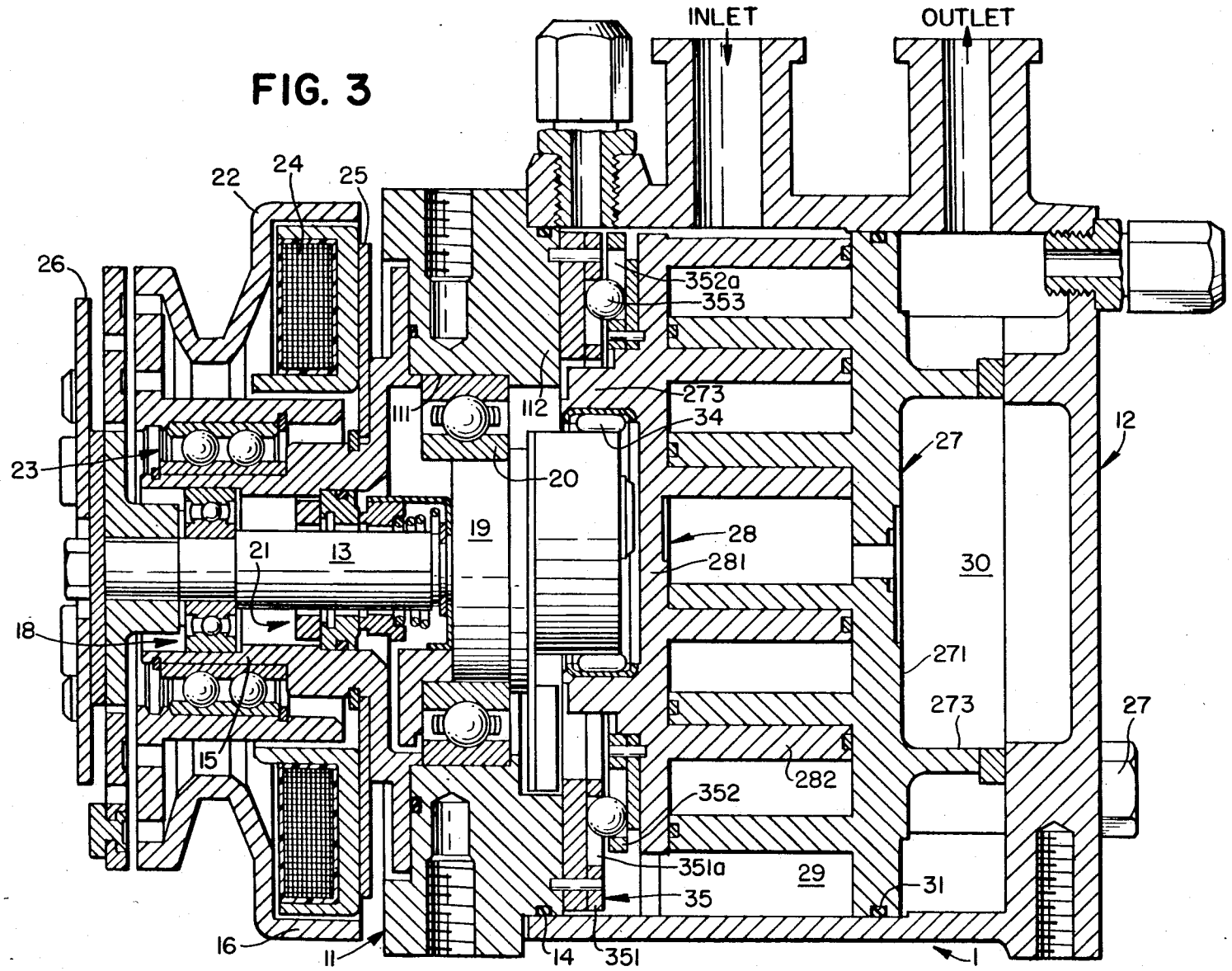
FIG. 3 is a vertical sectional view of a scroll type compressor unit in accordance with one embodiment of this invention.
Figure 4:
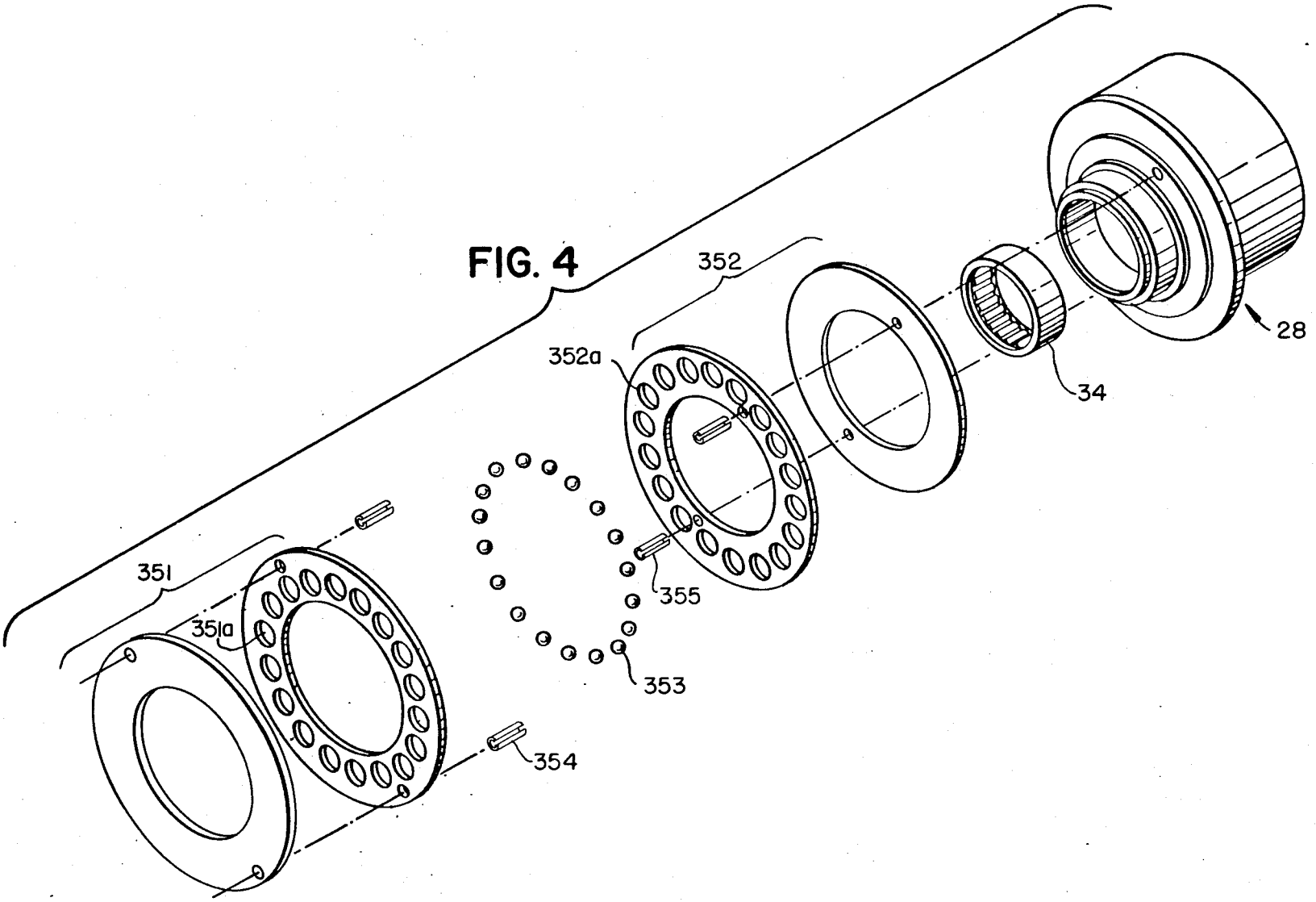
FIG. 4 is an exploded perspective view of the rotation preventing/thrust bearing device of the scroll type compressor unit of FIG. 3.

Referring to FIG. 3, a scroll type fluid displacement apparatus in accordance with the present invention is shown in the form of scroll type compressor unit 1. Compressor 1 includes compressor housing 10 having front end plate 11 and cup-shaped casing 12 which is attached to an end surface of front end plate 11. Opening 111 is formed in the center of front end plate 11 for penetration or passage of drive shaft 13. Annular projection 112 is formed in a rear end surface in front end plate 11. Annular projection 112 faces cup-shaped casing 12 and is concentric with opening 111. An outer peripheral surface of annular projection 112 extends into an inner wall of the opening of cup-shaped casing 12. Thus, the opening of cup-shaped casing 12 is covered by front end plate 11. An O-ring 14 is placed between the outer peripheral surface of annular projection 112 and the inner wall of the opening of cup-shaped casing 12 to seal the mating surfaces of front end plate 11 and cup-shaped 12.

Annular sleeve 15 projects from the front end surface of front end plate 11 to surround drive shaft 13 and define a shaft seal cavity. In the embodiment shown in FIG. 3, since sleeve 15 is formed separately from front end plate 11, sleeve 15 is fixed to the front end surface of front end plate 11 by screws (not shown). O-ring 16 is placed between the end surface of sleeve 15 and the front end surface of front end plate 11 to seal the mating surface of front end plate 11 and sleeve 15. Alternatively, sleeve 15 may be formed integral with front end plate 11.

Drive shaft 13 is rotatably supported by sleeve 15 through bearing 18 located within the front end of sleeve 15. Disk 19, which is mounted on the inner end of drive shaft 13, is rotatably supported by front end plate 11 through bearing 20 located within opening 111 of front end plate 11. Shaft seal assembly 21 is coupled to drive shaft 13 within the shaft seal cavity of sleeve 15.

Pulley 22 is rotatably supported by bearing 23, which is carried on the outer surface of sleeve 15. Electromagnetic coil 24 is fixed about the outer surface of sleeve 15 on support plate 25 and is received in an annular cavity of pulley 22. Armature plate 26 is elastically supported on the outer end of drive shaft 13 which extends from sleeve 15. Pulley 22, magnetic coil 24 and armature plate 26 form a magnetic clutch. In operation, drive shaft 13 is driven by an external power source, for example the engine of an automobile, through a rotation transmitting device such as the above described magnetic clutch.

A number of elements are located within the inner chamber of cup-shaped casing 12 including fixed scroll 27, orbiting scroll 28, a driving mechanism for orbiting scroll 28 and rotation preventing/thrust bearing device 35. The inner chamber of cup-shaped casing 12 is formed between the inner wall of cup-shaped casing 12 and the rear end surface of front end plate 11.

Fixed scroll 27 includes circular end plate 271 and wrap or spiral element 272 affixed to or extending from one end surface of end plate 271. Fixed scroll 27 is fixed within the inner chamber of cup-shaped casing 12 by screws 47 screwed into end surface 271 from outside of cup-shaped casing 12. Circular end plate 271 of fixed scroll 27 partitions the inner chamber of cup-shaped casing 12 into front chamber 29 and rear chamber 30. Seal ring 31 is disposed within a circumferential groove of circular end plate 271 to form a seal between the inner wall of cup-shaped casing 12 and the outer surface of circular end plate 271. Spiral element 272 of fixed scroll 27 is located within front chamber 29.

Orbiting scroll 28, which is located in front chamber 29, includes circular end plate 281 and wrap or spiral element 282 affixed to or extending from one end surface of circular end plate 281. Spiral elements 272 and 282 interfit at an angular offset of 180° and at a predetermined radial offset. Spiral elements 272 and 282 define at least one pair of sealed off fluid pockets between their interfitting surfaces. Orbiting scroll 28 is rotatably supported by bushing 33 through bearing 34 placed between the outer peripheral surface of bushing 33 and the inner surface of boss 273 projecting from the other end surface of circular end plate 281. Bushing 33 is connected to an inner end of disk 19 at a point radially offset or eccentric of the axis of drive shaft 13.

Rotation preventing/thrust bearing device 35 is placed around boss 273 of orbiting scroll 27 and between the inner end surface of fron end plate 11 and the end surface of circular end plate 281 which faces the inner end surface of front end plate 11. Rotation preventing/thrust bearing device 35 includes fixed ring 351 attached to the inner end surface of front end plate member 11, orbiting ring 352 attached to the end surface of circular end plate 231, and a plurality of bearing elements, such as balls 353, placed between pockets 351*a*, 352*a* formed by ring 351 and 352. Rotation of orbiting scroll 28 during oribital motion is prevented by the interaction of balls 353 with rings 351, 352. The axial thrust load from orbiting scroll 28 is supported on front end plate 11 through balls 353.

Cup-shaped casing 12 has inlet port 36 and outlet port 37 for connecting the compressor unit to an external fluid circuit. Fluid from the external fluid circuit is introduced into fluid pockets in the compressor unit through inlet port 36. The fluid pockets comprise open spaces formed between spiral elements 272 and 282, and as orbiting scroll 28 orbits, the fluid in the fluid pockets moves to the center of the spiral elements and is compressed. The compressed fluid from the fluid pockets is discharged into discharge chamber 301 of rear chamber 30 from the fluid pockets through hole 274 formed through circular end plate 271. The compressed fluid is then discharged to the external fluid circuit through outlet port 37.

Figure 5:
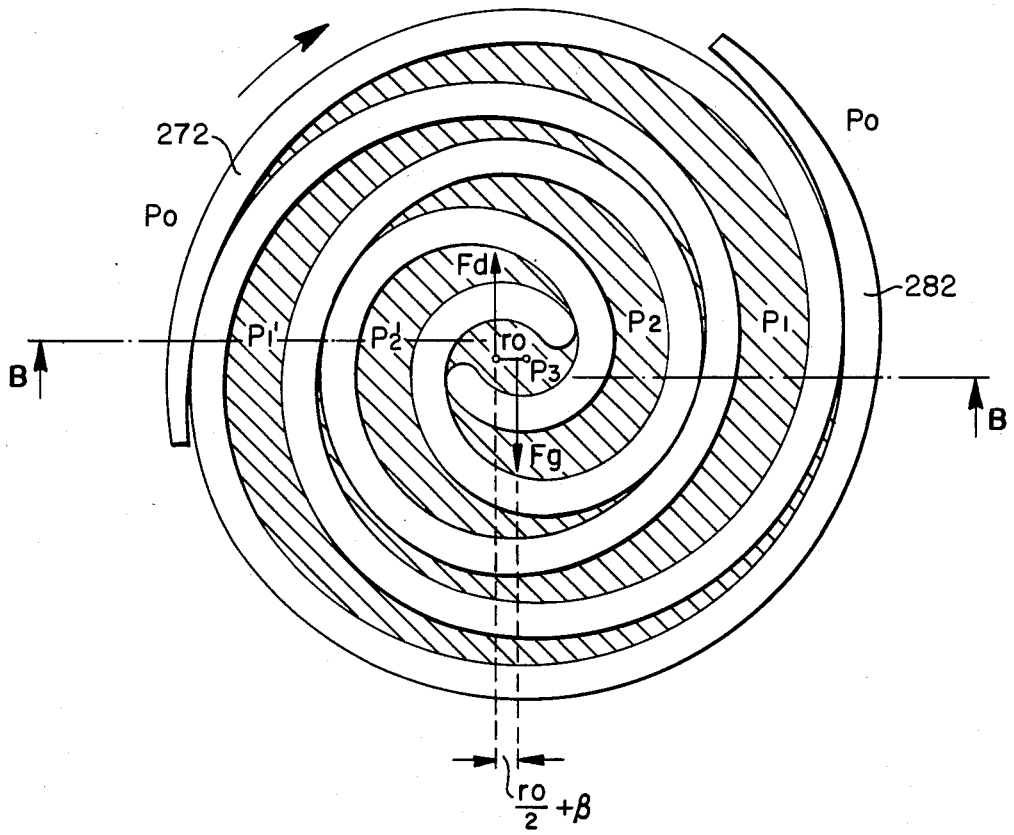
FIG. 5 is a diagrammatic sectional view illustrating the relationship between the fixed and orbiting scrolls of this invention.
Figure 6:
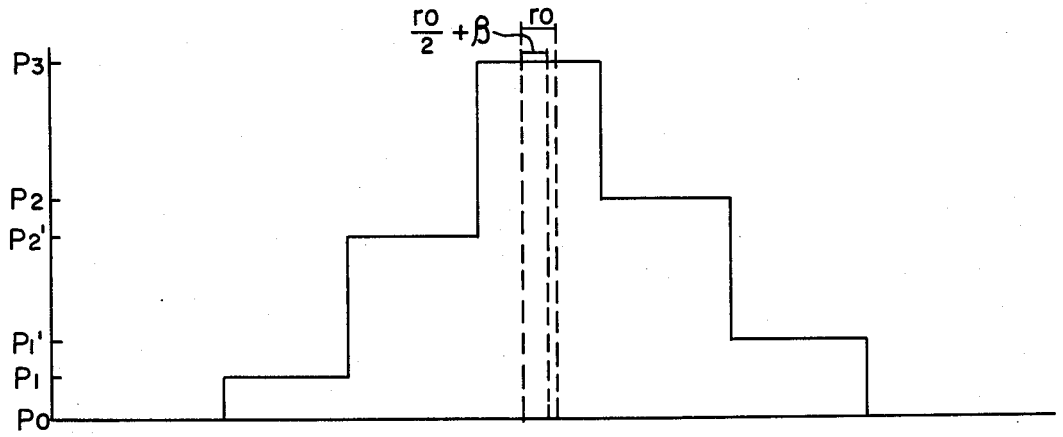
FIG. 6 is a pressure distribution graph illustrating the pressure in the fluid pockets of the scrolls of FIG. 5 taken along line B—B in FIG. 5.

In this arrangement, as shown in FIG. 5, the radial length of spiral element 282 of orbiting scroll 28 is longer than the radial length of spiral element 272 of fixed scroll 27, the radial length of a spiral being defined as the radial distance from the center of the spiral generating circle to the end point of the spiral. In this arrangement, as shown in FIG. 5, not only is the radial length of the spiral element 282 longer than the radial length of the spiral element 272, the linear length of the inner side surface of spiral element 282 is correspondingly longer than the linear length of the inner side surface of spiral element 272. Since the inner side surface of each spiral element defines the fluid pockets, if the length of the inner side surface of each spiral element is different, a particular pair of fluid pockets will be sealed off at different times, i.e., shifted. As a result, the gas pressure distribution within the interfitting scrolls is asymmetrical as shown in FIG. 6, i.e., the pressure in the fluid pockets along the line connecting the contact point between both spiral elements is asymmetrical at the center of both scrolls. As a result, the acting point of the resultant force Fg is offset toward the higher side of the pressure distribution so that the distance between the acting point of the resultant force Fg and the center of the orbiting scroll on which the reaction force Fd acts is longer than half the crank radius $r_o$. Thus, the moment of rotation or the rotating force of orbiting scroll 28 is defined by the following formula:

$$Fg \times \left(\frac{r_o}{2} + \beta\right),$$

wherein $\left(\frac{r_o}{2} + \beta\right)$ is the distance between the acting point of resultant force Fg and the center of the orbiting scroll.

Figure 1:
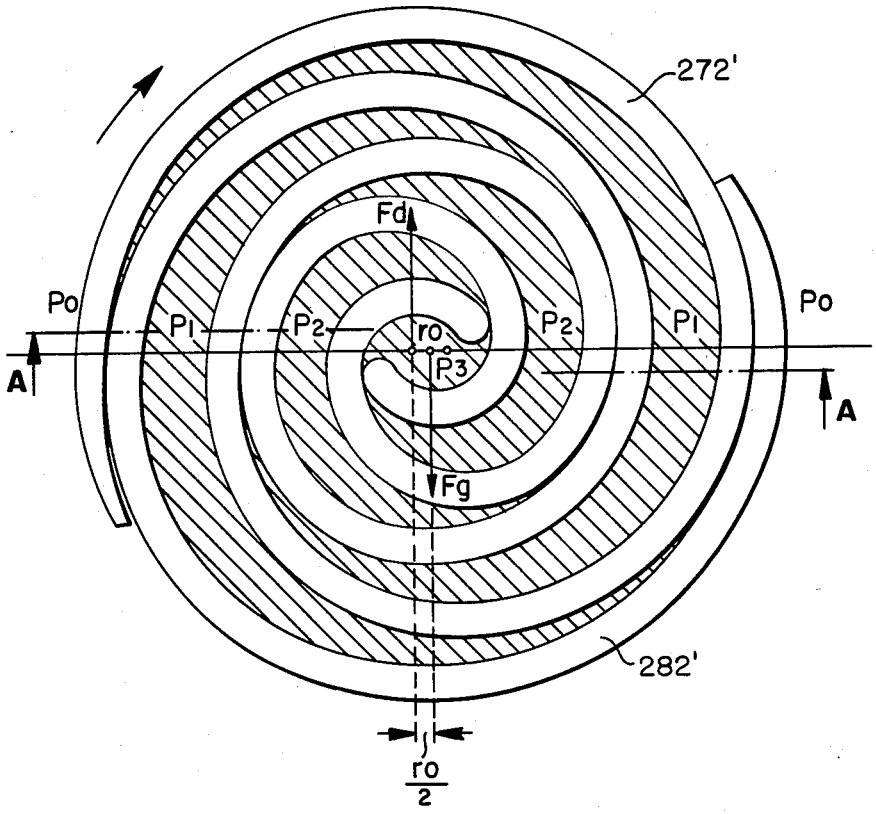
FIG. 1 is a diagrammatic sectional view illustrating the relationship between conventional fixed and orbiting scrolls.
Figure 2:
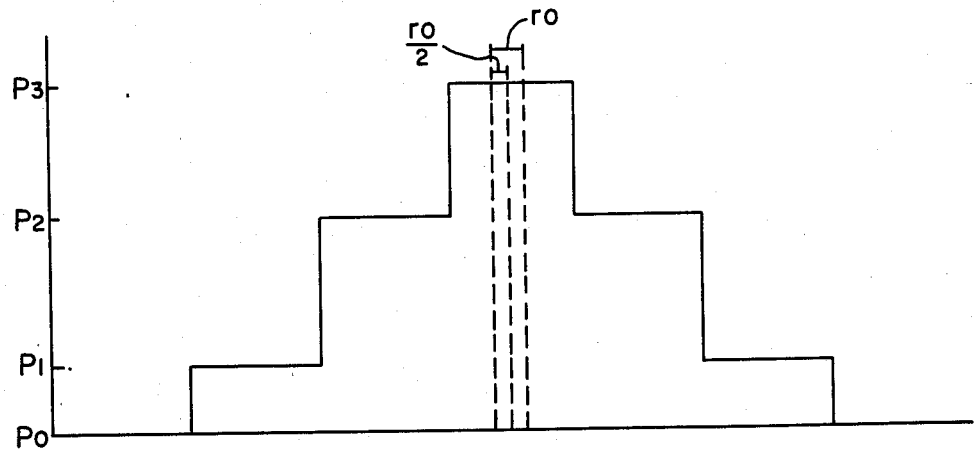
FIG. 2 is a pressure distribution graph illustrating the gas pressure in the fluid pockets of the scrolls of FIG. 1 taken along line A—A in FIG. 1.

Comparing the above rotating force with the conventional rotating force described above in connection with FIGS. 1 and 2, the rotating force defined by $$Fg \times \left(\frac{r_o}{2} + \beta\right)$$

is greater than the conventional rotating force defined by $$Fg \times \frac{1}{2} r_o.$$

Thus, the magnitude of force acting on the rotation preventing/thrust bearing device is much greater to thereby tightly secure the balls of the rotation preventing/thrust bearing device within the pockets. As a consequence, the vibration of the orbiting scroll occasioned by the play in the balls of the rotation preventing/thrust bearing device is prevented.

Although an illustrative embodiment of the invention has been described in detail with reference to the accompanying drawings, it is to be understood that the invention is not limited to those precise embodiments. Various modifications may be effected therein by one skilled in the art without departing from the scope and spirit of the invention.

I claim:

1. In a scroll type fluid displacement apparatus including a pair of scrolls each having a circular end plate from which a spiral wrap extends, said spiral wraps interfitting at an angular and radial offset to form a pluraity of line contacts to define at least one pair of sealed off fluid pockets, driving means operatively connected to one of said scrolls for driving said one scroll to effect orbital motion of said one scroll during orbital motion to thereby change the volume of the fluid pockets, the improvement comprising a linear length of an inner side surface of said spiral wrap of said one scroll formed longer than the linear length of an inner surface of said spiral wrap of the other scroll to shift the sealed off time of said fluid pockets to generate an assymmetrical gap pressure distribution within said spiral wraps to thereby increase the moment of rotation of said one scroll.

2. The scroll type fluid displacement apparatus of claim 1 wherein said one scroll is an orbiting scroll.

3. The scroll type fluid displacement apparatus of claim 2 wherein said rotation preventing means is a ball coupling device.

4. The scroll type fluid displacement apparatus of claim 3 wherein the moment of rotation is defined by $$Fg \times \left(\frac{r_o}{2} + \beta\right)$$

where $F_g$ is the resultant force of gas pressure acting on the spiral element and $$\left(\frac{r_o}{2} + \beta\right)$$

is the distance between the acting point of resultant force $F_g$ and the center of the orbiting scroll, and acts on the balls of said coupling device to prevent vibration of said ball coupling device during orbital motion of said orbiting scroll.

* * * * *

UNITED STATES PATENT AND TRADEMARK OFFICE

CERTIFICATE OF CORRECTION

PATENT NO. : 4,626,179

DATED : December 2, 1986

INVENTOR(S) : Kiyoshi Terauchi

It is certified that error appears in the above-identified patent and that said Letters Patent is hereby corrected as shown below:

In claim 1, line 8, after "scroll" insert --and rotation preventing means for preventing the rotation of said one scroll--.

In claim 4, line 9, after "said" insert --ball--.

Signed and Sealed this

Eighth Day of December, 1987

*Attest:*

DONALD J. QUIGG

*Attesting Officer*

*Commissioner of Patents and Trademarks*